US005735673A

United States Patent [19]

Matheny et al.

[11] Patent Number: 5,735,673

[45] Date of Patent: Apr. 7, 1998

[54] TURBINE ENGINE ROTOR BLADE PAIR

[75] Inventors: Alfred Paul Matheny, Jupiter, Fla.; Chen Yu J. Chou, Cincinnati, Ohio

[73] Assignee: United Technologies Corporation, Hartford, Conn.

[21] Appl. No.: 759,827

[22] Filed: Dec. 4, 1996

[51] Int. Cl.[6] ..... F04D 29/38

[52] U.S. Cl. ..... 416/223 A; 416/230; 416/248

[58] Field of Search ..... 416/193 A, 204 A, 416/223 A, 230, 248

[56] References Cited

U.S. PATENT DOCUMENTS

| | | | |
|---|---|---|---|
| 2,277,484 | 3/1942 | Flanders | 416/193 A |
| 3,266,770 | 8/1966 | Harlow | 416/193 A |
| 3,597,109 | 8/1971 | Petrie et al. | 416/193 A |
| 4,022,547 | 5/1977 | Stanley | 416/230 |
| 4,098,559 | 7/1978 | Price | 416/230 |
| 4,108,572 | 8/1978 | Platt | 416/230 |
| 4,111,606 | 9/1978 | Prewo | 416/224 |
| 4,191,510 | 3/1980 | Teysseyre et al. | 416/230 |
| 4,364,160 | 12/1982 | Eiswerth et al. | 29/156.8 H |
| 5,135,354 | 8/1992 | Novotny | 415/115 |
| 5,273,401 | 12/1993 | Griffin | 416/193 R |
| 5,277,548 | 1/1994 | Klein et al. | 416/193 A |
| 5,281,096 | 1/1994 | Harris et al. | 416/193 A |
| 5,292,231 | 3/1994 | Lauzeille | 416/229 A |
| 5,340,280 | 8/1994 | Schilling | 416/229 A |
| 5,388,964 | 2/1995 | Ciokajlo et al. | 416/204 A |
| 5,409,353 | 4/1995 | Imbault | 416/212 A |

*Primary Examiner*—John T. Kwon
*Attorney, Agent, or Firm*—Richard D. Getz

[57] ABSTRACT

A rotor blade pair for rotation around an axial centerline is provided which includes a platform, a first and a second airfoil, and a root having a first and second wall. The platform has an inner and an outer radial surface. The first and second airfoils extend out from the outer radial surface of the platform. The root walls extend out from said inner radial surface of the platform, and are integrally connected to one another, forming a hollow between the walls and the inner radial surface. The first wall is substantially aligned with the first airfoil and the second wall is substantially aligned with the second airfoil.

18 Claims, 5 Drawing Sheets

FIG.2
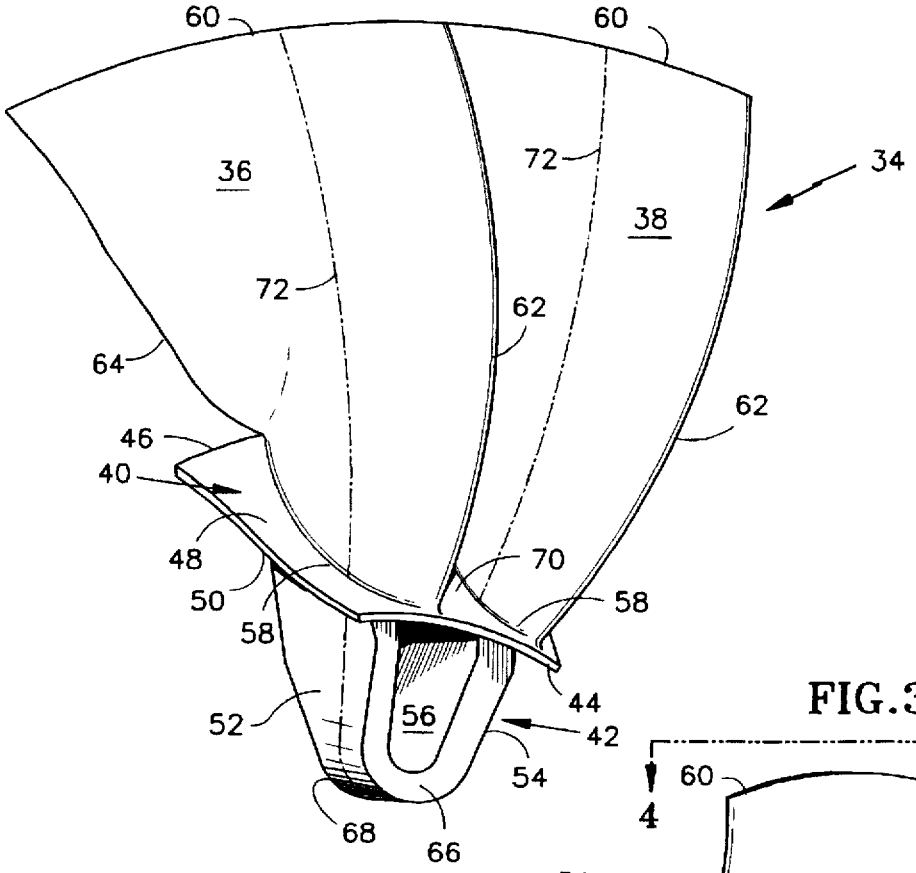
FIG.3
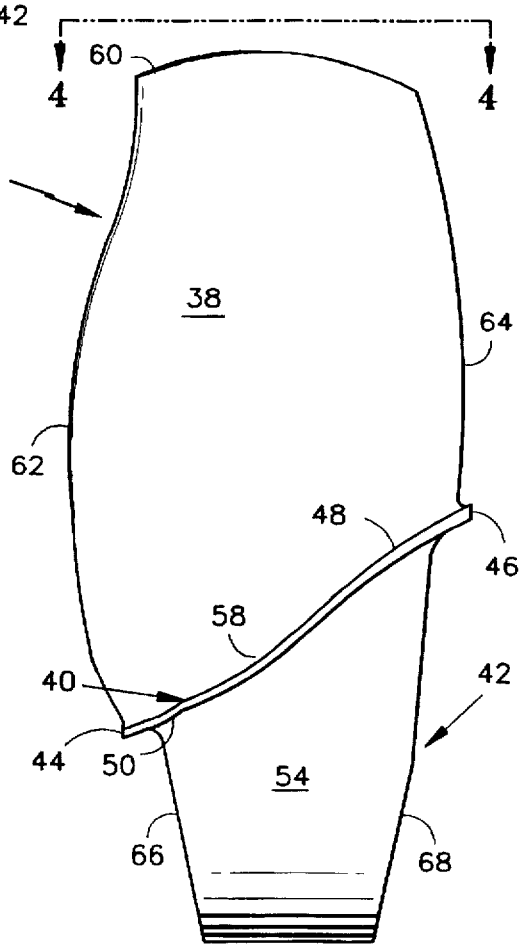
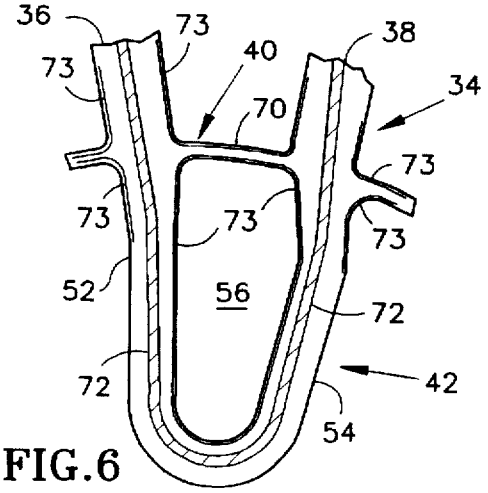
FIG.6

FIG.4
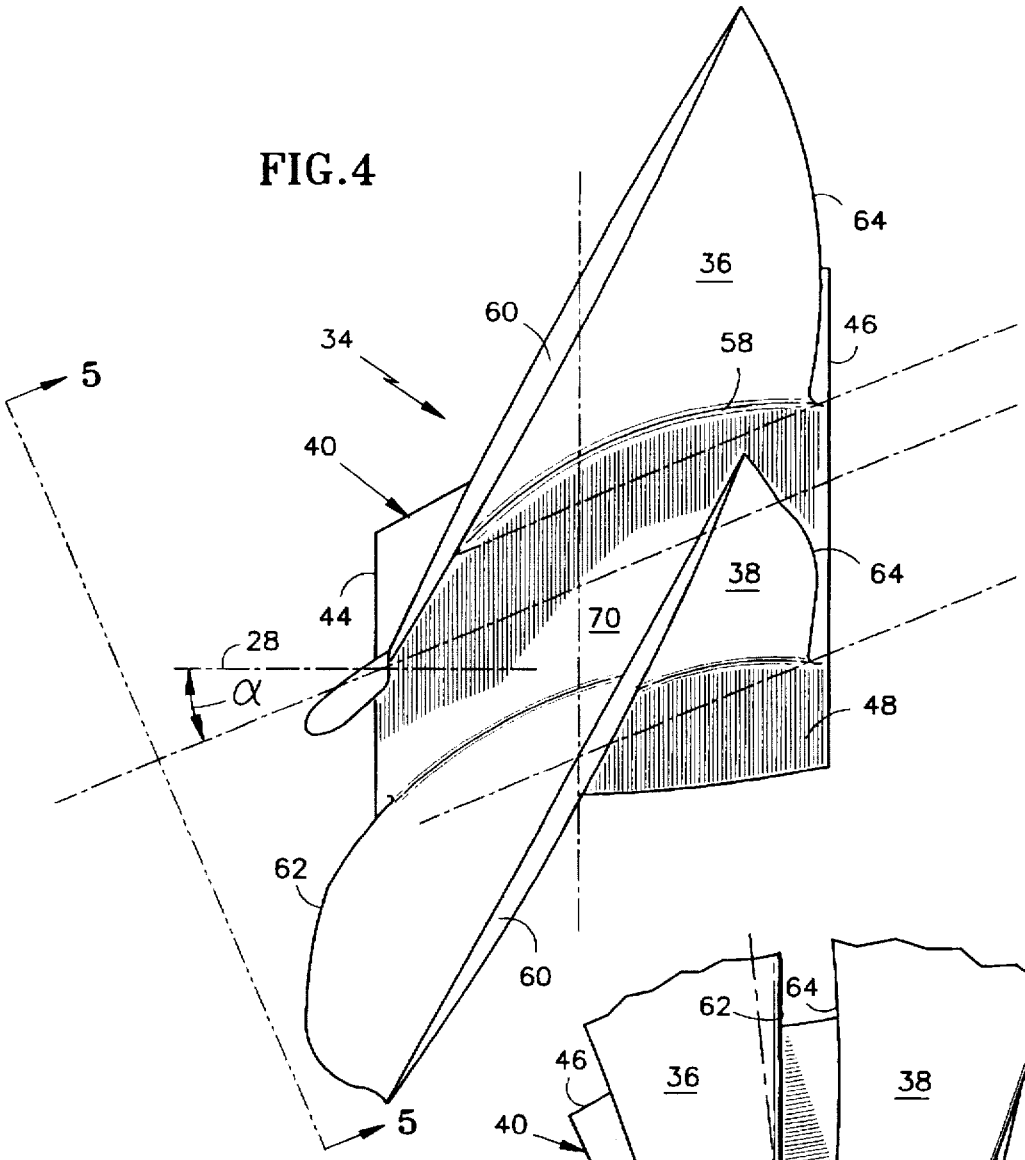
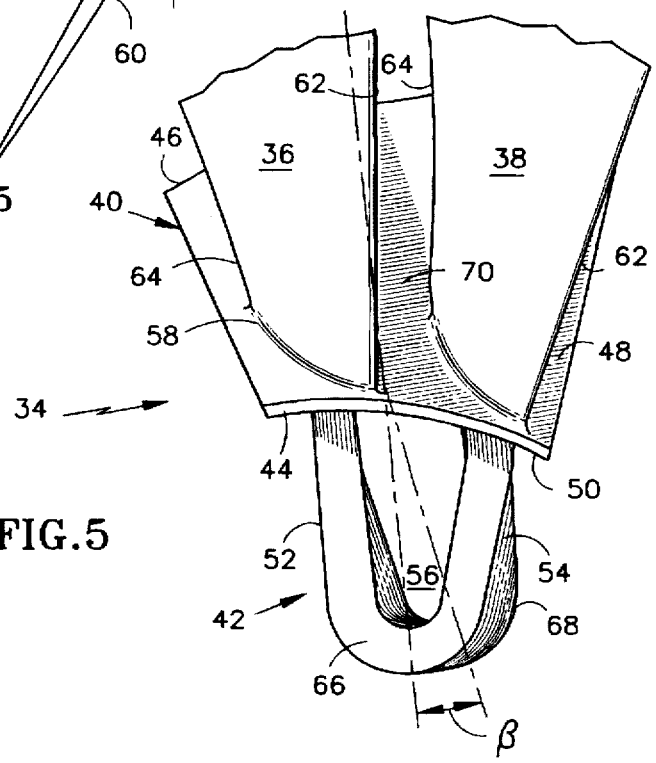
FIG.5

TURBINE ENGINE ROTOR BLADE PAIR

BACKGROUND OF THE INVENTION

1. Technical Field

The present invention relates to gas turbine engine rotor assemblies in general, and to rotor blades in particular.

2. Background Information

Axial turbine engines generally include fan, compressor, combustor and turbine sections positioned along an axial centerline sometimes referred to as the engines "axis of rotation". The fan, compressor, and combustor sections add work to air (also referred to as "core gas") flowing through the engine. The turbine extracts work from the core gas flow to drive the fan and compressor sections. The fan, compressor, and turbine sections each include a series of stator and rotor assemblies. The stator assemblies, which do not rotate (but may have variable pitch vanes), increase the efficiency of the engine by guiding core gas flow into or out of the rotor assemblies.

The rotor assemblies typically include a plurality of blades attached to and extending out from the circumference of a disk. It is known to attach rotor blades to a disk by "fir tree" blade mots or the like, received in complementary shaped recesses within the disk. A disadvantage of a "fir tree" type attachment scheme is that the disk must be sized relatively large to accommodate the stresses generated by the blades acting on the disk. Specifically, the disk must have sufficient area between adjacent recesses to handle the shear load placed on the recesses by the mating roots of the rotor blades. Another method of rotor blade attachment involves using a pin to hold the rotor blades to the disk. In a pinned application, the blade root of each blade necks down to a lug having an aperture for receiving a pin. The lug is received between flanges extending out from the disk. The pin extends through the disk flanges and blade lug to secure the blade to the disk. The entire load on the blade is borne by the pin, which in turn transfers the load to the disk flanges. To avoid undesirable stress levels, the cross-sectional area of the pin must be substantial and the disk must have adequate web material between adjacent pin apertures. Typically, adequate web material is attained by moving the pin apertures radially outward. The substantial pin diameter and radial position of the pin apertures often lead to a rotor disk having a weight and an internal flow path diameter greater than optimum.

Hence, what is needed is a gas turbine rotor assembly with minimal weight, one having rotor blades that can accommodate high radial loads, and one with increased resistance to foreign object damage.

DISCLOSURE OF THE INVENTION

It is, therefore, an object of the present invention to provide an axial turbine engine rotor assembly that has a minimal internal flow path diameter.

It is another object of the present invention to provide an axial turbine engine rotor assembly of minimal weight.

It is another object of the present invention to provide a rotor blade for an axial turbine engine that can accommodate high radial loads.

It is another object of the present invention to provide a rotor assembly for an axial turbine engine with increased resistance to foreign object damage.

According to the present invention, a rotor blade pair is provided which includes a platform, a first and a second airfoil, and a root having a first and second wall. The platform has an inner and an outer radial surface. The first and second airfoils extend out from the outer radial surface of the platform. The root walls extend out from the inner radial surface of the platform, and are integrally connected to one another, forming a hollow between the walls and the inner radial surface. The first wail is substantially aligned with the first airfoil and the second wall is substantially aligned with the second airfoil.

According to one aspect of the present invention, the first and second airfoils, and the aligned first and second wails of the root, are skewed from the axial centerline of the engine.

According to another aspect of the present invention, the first and second airfoils, spiral around an axis extending between the forward and aft edges of each airfoil. The first and second walls of the root spiral around an axis extending between the forward and aft edges of the root, an amount substantially equal to that of the airfoils, thereby maintaining the alignment between the airfoils and the walls of the root.

An advantage of the present invention is that a rotor blade pair is provided having a significant radial load capability. One factor contributing to the radial load capability of the present rotor blade pair is the alignment of the airfoils with the root walls. Alignment between an airfoil and a blade root wail permits the radial pull lines ("radial pull line" is a term of art used to describe the force vectors extending through an airfoil) of the airfoil to continue into the blade root and thereby minimize stresses elsewhere in the blade pair. In the present invention, the airfoils and root walls are aligned regardless of the orientation of the airfoils relative to the platform; i.e., airfoils spiraling out of the platform, or being skewed from the axial centerline of the engine, or both. Another factor contributing to the radial load capacity of the present invention rotor blade pairs are the first fibers extending from airfoil to airfoil, via the root. The continuous first fibers connecting the airfoils to the blade root reinforce the blade pair and thereby increase the radial load capability.

Another advantage of the present invention is its ability to withstand foreign object damage. The platform of the present invention is designed to dissipate energy delivered by foreign objects impacting one or both blade pair airfoils.

Another advantage of the present invention is that a lightweight rotor blade assembly is provided. The present invention rotor blade assembly avoids a solid rotor disk and heavy alloy rotor blades.

These and other objects, features and advantages of the present invention will become apparent in light of the detailed description of the best mode embodiment thereof, as illustrated in the accompanying drawings.

DESCRIPTION OF THE DRAWINGS

FIG. 2 is a diagrammatic perspective view of the present invention rotor blade pair.

FIG. 3 is a diagrammatic side view of the rotor blade pair shown in FIG. 2.

FIG. 4 is a diagrammatic radially inward view of the blade pair shown in FIG. 3.

FIG. 5 is a diagrammatic axial view of the blade pair shown in FIG. 4.

FIG. 6 is a diagrammatic partial view of a composite rotor blade pair showing first and second fibers.

BEST MODE FOR CARRYING OUT THE INVENTION

Figure 1:
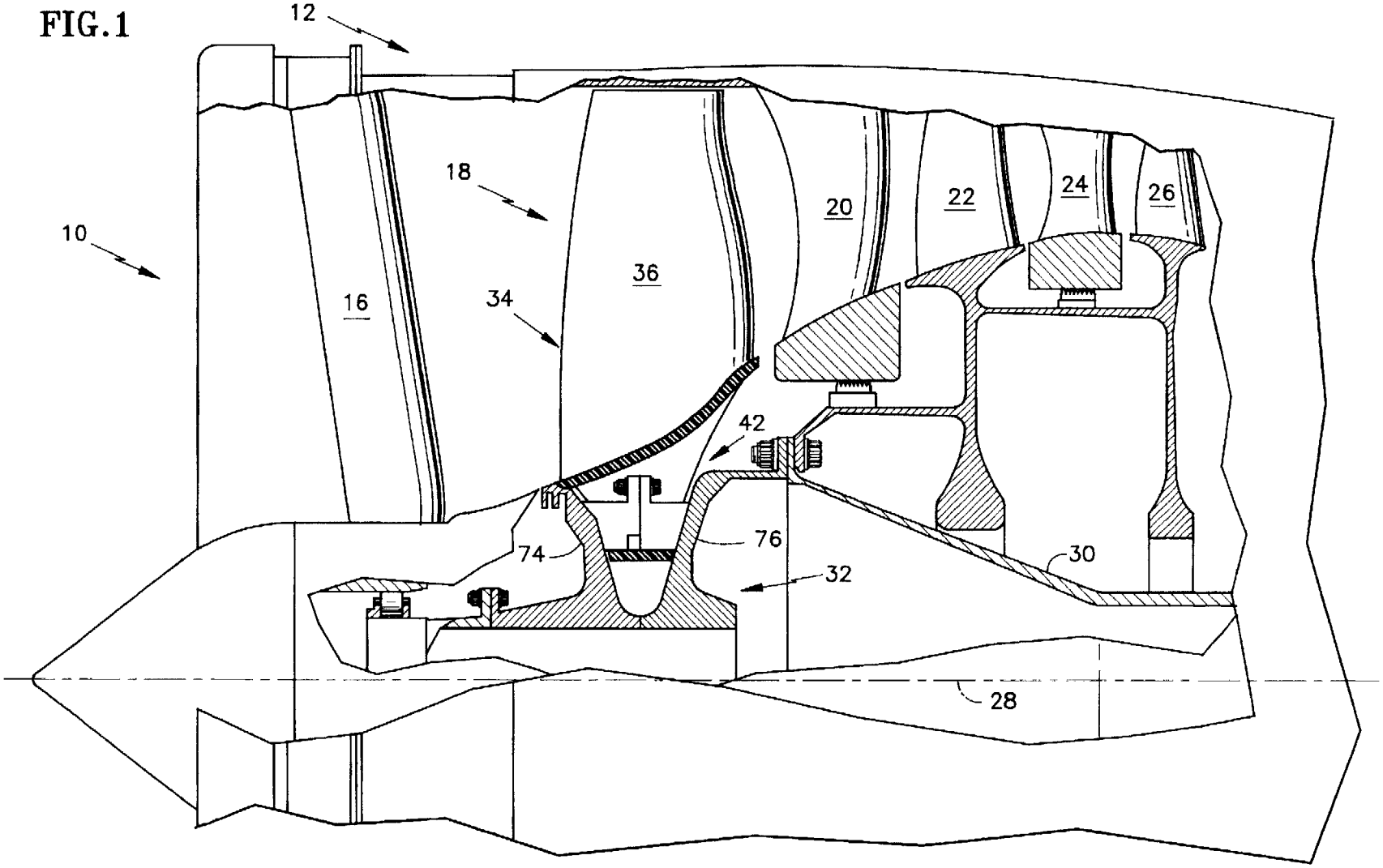
FIG. 1 is a diagrammatic view of the fan section of a gas turbine engine.
Figure 7:
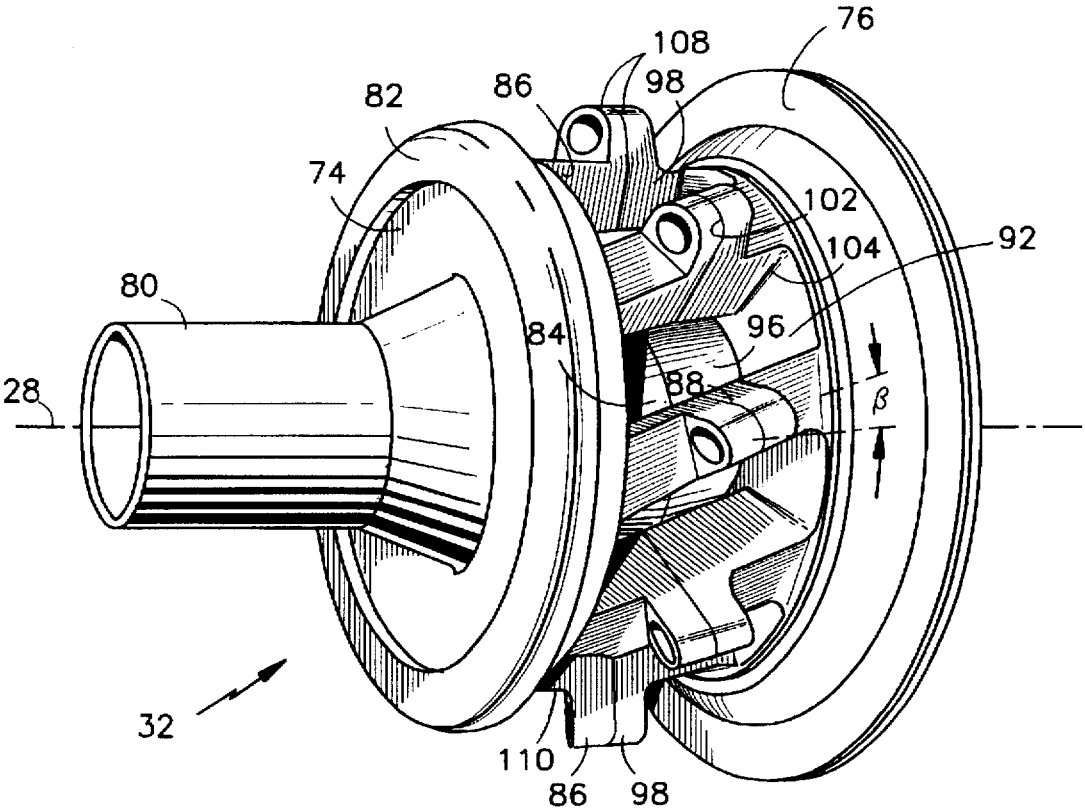
FIG. 7 is a diagrammatic perspective view of the present invention rotor disk.
Figure 8:
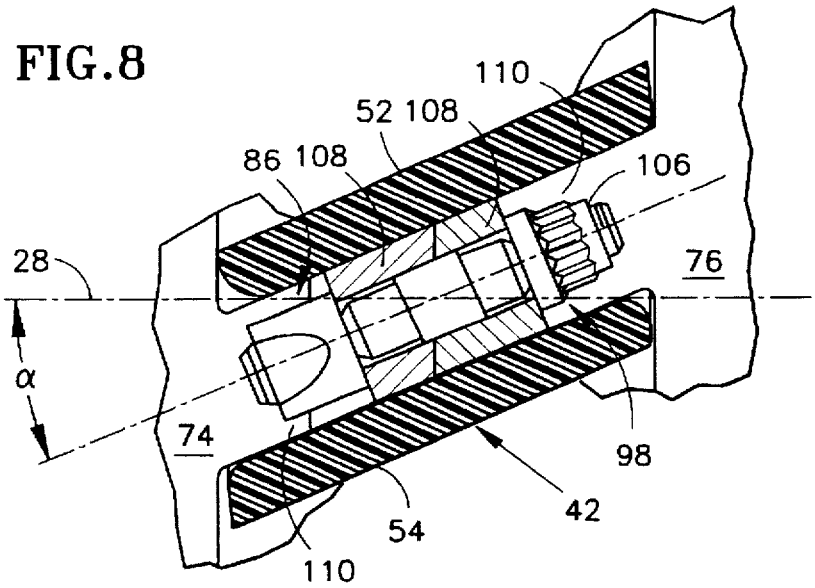
FIG. 8 is a diagrammatic perspective looking radially inward toward the disk, showing a pair of stub shafts extending out from the respective web, coupled with a fastener.

Referring to FIG. 1, an axial turbine engine 10 includes a fan section 12 which has a plurality of inlet guide vanes 16, a first rotor stage 18, a first stator stage 20, a second rotor stage 22, a second stator stage 24, and a third rotor stage 26, positioned forward to aft respectively. Forward is defined as being upstream of aft. The inlet guide vanes 16 and the stator stages 20, 24 guide air into, or out of, the rotor stages 18,22,26. The first, second, and third rotor stages 18,22,26 rotate about the axial centerline 28 of the engine 10. A spool 30 powered by a downstream turbine (not shown) drives the fan rotor stages 18,22,26. The first rotor stage 18 includes a rotor disk 32 and a plurality of rotor blade pairs 34, distributed around the circumference of the disk 32.

I. The Rotor Blades

Referring to FIGS. 2–6, each rotor blade pair 34 includes a first airfoil 36, a second airfoil 38, a platform 40, and a root 42. The platform 40 has a forward edge 44, an aft edge 46, an outer radial surface 48, and an inner radial surface 50. The airfoils 36,38 are spaced apart and substantially parallel to one another, and extend out from the outer radial surface 48 of the platform 40. The root 42 of each blade pair 34 includes a first 52 and a second 54 root wall, integrally attached to one another, extending out from the inner radial surface 50 of the platform 40. The hollow 56 formed between blade root walls 52,54 has a cross-sectional geometry similar to that of the rotor disk stub shafts 86,98 (discussed in more detail hereinafter).

Referring to FIGS. 4 and 5, for aerodynamic reasons the airfoils 36,38 are skewed from the axial centerline 28 by an angle "α" which extends between the chord line of the airfoils 36,38 and the axial centerline 28. In addition, the blade pair airfoils 36,38 spiral in a compound manner between the base 58 and the tip 60, and between the forward 62 and aft 64 edges, of each airfoil 36,38. At the base 58 of each airfoil 36,38, the airfoil spirals almost exclusively around an axis extending between the forward 62 and aft 64 edges. The base 58 to tip 60 component of the airfoil spiral increases with radial position away the base 58, and is therefore less significant at the base 58. As a result of the spiral, the airfoils 36,38 do not intersect the platform 40 along a constant plane. A person of skill in the art will recognize that aerodynamic, manufacturing, and stress concerns influence the exact contour of most rotor blade airfoils, and that the airfoil contour may have small anomalies that deviate from the symmetry of the airfoil.

Each blade root wall 52,54 is substantially aligned with one of the airfoils 36,38 and consequently spirals in a manner equal to, or nearly equal to, that of the airfoil 36,38. The blade root walls 52,54, like the airfoils 36,38, may have small anomalies that deviate from the symmetry of the blade root walls 52,54. The angle "β" shown in FIG. 5 illustrates the amount of spiral within the blade root 42 between the forward 66 and aft 68 edges of the blade root 42.

Referring to FIG. 2, in the preferred embodiment the blade pairs 34 are fabricated from composite materials which include a plurality of first 72 and second 73 fibers disposed within a composite matrix. The first fibers 72 extend from, or near, the tip 60 of one airfoil 36,38 down through the platform 40, into one blade root wall 52,54, up through the other blade root wall 54,52, back through the platform 40, and into the other airfoil 38,36, terminating at or near the tip 60. The second fibers 73 are positioned adjacent the first fibers 72, extending along the airfoils 36,38 and root 42. The second fibers 73 also extend throughout the platform 40. For example, second fibers 73 can extend from a section of platform 40 into a blade root wall 52,54, or from the platform 40 into an airfoil 36,38, or from one airfoil 36,38 through the platform interblade region 70, and into the other airfoil 38,36. The first fibers 72 have a Modulus of Elasticity value higher than that of the second fibers 73, and are therefore "stiffer" than the second fibers 73. The second fibers 73, however, have a higher percentage of elongation at failure than the first fibers 72.

The distribution of the first 72 and second 73 fibers within the blade pair 34 and the mechanical properties of the first 72 and second 73 fibers give the blade pair 34 desirable performance characteristics. The alignment between the airfoils 36,38 and blade root walls 52,54 enables the first fibers 72 to extend in a continuous manner through out the blade pair 34. As a result, the radial pull lines extend linearly, or nearly linearly, through each airfoil 36,38 and its aligned blade root wall 52,54, which in turn optimizes the load capacity of the blade pair 34. The distribution of the lesser strength second fibers 73, particularly in the platform interblade region 70, gives the blade pair 34: 1) adequate shear and bending stiffness to avoid vibration related fatigue problems; and 2) the ability to dissipate energy transferred from a foreign object impacting one or both airfoils. Lower energy foreign object impacts are accommodated by allowing the energy of the impact to transfer into and dissipate within the platform 40, thereby minimizing the damage to the airfoil(s) 36,38 and root 42. Higher energy foreign object impacts are also accommodated by transferring the energy of the impact into the platform 40. If the impact energy is great enough, however, the platform will partially or completely buckle and fail while dissipating the energy of the impact. The platform 40 is sacrificed, if necessary, to keep the airfoils 36,38 attached, which in turn minimizes further damage within the engine 10. The constituent material of the first 72 and second 73 fibers will depend upon the application at hand. Carbon fibers and glass fibers are examples of first and second fiber materials, respectively.

II. The Rotor Disk

Referring to FIGS. 1, and 7–9, the rotor disk 32 includes a forward web 74 and an aft web 76. The forward web 74 includes an inner surface 78, a forward spool attachment member 80, a forward flange 82, a center hub 84, and a plurality of first stub shafts 86. The inner surface 78 is disposed at an angle "φ" relative to a radial line 80 perpendicular to the axial centerline 28. The first stub shafts 86 are distributed around the circumference of the forward web 74, extending out from the inner surface 78. Each first stub shaft 86 extends lengthwise between an axial end 88 and a web end 90. The web end 90 of each first stub shaft 86 is preferably integrally attached, by a metallurgical bond for example, to the inner surface 78 of the forward web 74.

The aft web 76 includes an inner surface 92, an aft spool attachment member 94, a center hub 96, and a plurality of second stub shafts 98. The inner surface 92 of the aft web 76 is disposed at an angle "λ" relative to a radial line 100 perpendicular to the axial centerline 28. The second stub shafts 98 are distributed around the circumference of the aft web 76, extending out from the inner surface 92. Each second stub shaft 98 extends lengthwise between an axial end 102 and a web end 104. The web end 104 of each second stub shaft 98 is preferably integrally attached, by a metallurgical bond for example, to the inner surface 92 of the aft web 76.

Figure 9:
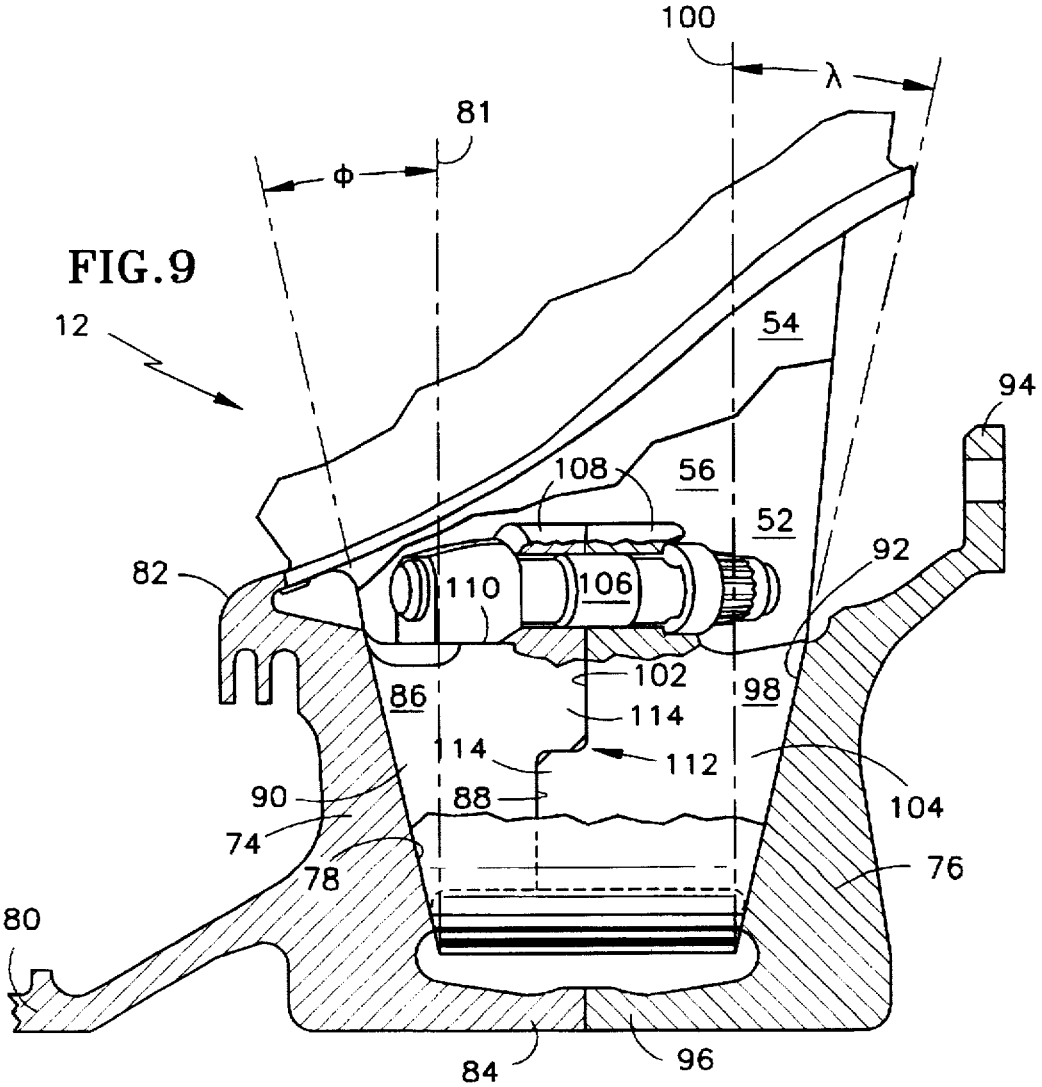
FIG. 9 is a diagrammatic partial view of the present invention with a disk attached thereto, shown partially broken away.

The first and second stub shafts 86,98 are equal in number, and similarly spaced around the axial centerline 28. Each first stub shaft 86 aligns with a second stub shaft 98, and vice versa. A plurality of fasteners 106, such as nut and bolt pairs, attach the first and second stub shafts 86,98, and therefore the webs 74,76, to one another. In the preferred embodiment, each first and second stub shaft 86,98 includes a flange 108 adjacent the axial end 88,102, extending out from the outer radial surface 110 of the stub shaft 86,98. The flanges 108 of thealigned stub shafts 86,98 align with one another, and the fasteners 106 couple the aligned stub shafts 86,98 through the flanges 108. The first and second stub shafts 86,98 may also include mating surfaces 112 disposed in the axial end 88,102 of each shaft 86,98. FIGS. 1 and 9, illustrate one embodiment of the mating surfaces 112 where each first and second stub shaft 86,98 includes a tongue 114 extending into the other shaft 98,86. Other mating surfaces 112 may be used alternatively.

The stub shafts 86,98 extend between the forward 74 and aft 76 webs, skewed from the axial centerline 28 and spiraling between webs 74,76 in a manner similar to that of the blade roots 42 described above. The amount of skew between the stub shafts 86,98 and the axial centerline 28 is substantially equal to the skew between the chord lines of the airfoils 36,38 and the axial centerline 28 and is, therefore, represented by the same angle "α". The amount of spiral (or "twist") along the length of the combined stub shafts 86,98 is likewise shown as angle "β", heretofore described as the amount of spiral within the blade pair root 42. The skew angle "α" and spiral angle "β" magnitudes will depend upon the application at hand. An advantage of the present invention is that a variety of skew angles and degrees of spiral can be accommodated, thereby giving the present invention considerable versatility.

Referring to FIG. 9, the fan section 12 is assembled by receiving the first stub shafts 86 in the blade root hollows 56 of an appropriate number of rotor blade pairs 34. Next, the second stub shafts 98 are inserted into the hollows 56 and aligned with the first stub shafts 86. At this point, the inner surfaces 78,92 of the forward 74 and aft 76 webs, disposed at angles "φ" and "λ" respectively, maintain the blade pairs 34 in position and thereby facilitate assembly. The fasteners 106 are subsequently inserted into the flanges 108 on the outer radial surface 110 of the stub shafts 86,98 and tightened to attach the stub shafts 86,98, and therefore the webs 74,76, together.

Although this invention has been shown and described with respect to the detailed embodiments thereof, it will be understood by those skilled in the art that various changes in form and detail thereof may be made without departing from the spirit and the scope of the invention. For example, the present invention rotor assembly is described herein as a fan rotor assembly. The present invention rotor assembly may be used in compressor and/or turbine applications alternatively. As a second example, present invention blade pairs 34 are described in the best mode as being composite structures. The blade pairs are not limited, however, to composite materials. A alloy blade pair 34 with a platform 40 designed to absorb energy in the manner described, could be used alternatively.

We claim:

1. A rotor blade pair, for rotation around an axial centerline, comprising:

a platform, having an inner and an outer radial surface;

a first airfoil, extending out from said outer radial surface of said platform;

a second airfoil, extending out from said outer radial surface of said platform; and wherein each said airfoil has a forward edge, an aft edge, a base and a tip;

a root, having a first wall, a second wall, a forward edge, and an aft edge, said walls extending out from said inner radial surface of said platform, and integrally connected to one another, forming a hollow between said walls and said inner radial surface;

wherein said first wall is substantially aligned with said first airfoil, and said second wall is substantially aligned with said second airfoil.

2. A rotor blade pair according to claim 1, wherein said first and second airfoils, and said aligned first and second walls of said root, are skewed from the axial centerline.

3. A rotor blade pair according to claim 1, wherein said first and second airfoils extend out from said outer radial surface, substantially parallel to one another, and said first and second walls of said root, aligned with said first and second airfoils, extend out from said inner radial surface, substantially parallel to one another.

4. A rotor blade pair according to claim 3, wherein said first and second airfoils, and said aligned first and second walls of said root, are skewed from the axial centerline.

5. A rotor blade pair according to claim 4, wherein said first and second airfoils, spiral around an axis extending between said forward and aft edges of each said airfoil.

6. A rotor blade pair according to claim 5, wherein said first and second walls of said root spiral around an axis extending between said forward and aft edges of said root, an amount substantially equal to that of said airfoils, thereby maintaining said alignment between said airfoils and said walls of said root.

7. A rotor blade pair according to claim 6, further comprising:

a plurality of first fibers, extending from adjacent said tip of said first airfoil, through said first airfoil, into and through said first and second walls, and through said second airfoil, extending up to adjacent said tip of said second airfoil.

8. A rotor blade pair according to claim 7, further comprising:

a plurality of second fibers, extending adjacent said first fibers, and disposed within said platform;

wherein said second fibers have a Modulus of Elasticity value less than that of said first fibers.

9. A rotor blade pair according to claim 8, wherein said second fibers have a higher percentage of elongation at failure, than said first fibers.

10. A rotor blade pair according to claim 1, further comprising:

a damper, wherein said damper dissipates energy transferred to said blade pair by a foreign object striking one of said airfoils.

11. A rotor blade pair according to claim 1, further comprising:

a plurality of first fibers, extending from adjacent said tip of said first airfoil, through said first airfoil, into and through said first and second walls, and through said second airfoil, extending up to adjacent said tip of said second airfoil; and a plurality of second fibers, extending adjacent said first fibers, and disposed within said platform;

wherein said second fibers have a Modulus of Elasticity value less than that of said first fibers.

12. A rotor blade pair according to claim 11, further comprising:

a damper, wherein said damper dissipates energy delivered to said blade pair by a foreign object striking one of said airfoils.

13. A rotor blade pair according to claim 12, wherein said damper comprises:

an interblade region of said platform, wherein said interblade region includes said second fibers.

14. A rotor blade according to claim 13, wherein said second fibers have a higher percentage of elongation at failure, than said first fibers.

15. A rotor blade pair according to claim 14, wherein said first and second airfoils extend out from said outer radial surface, substantially parallel to one another, and said first and second walls of said root, aligned with said first and second airfoils, extend out from said inner radial surface, substantially parallel to one another.

16. A rotor blade pair according to claim 15, wherein said first and second airfoils, and said aligned first and second walls of said root, are skewed from the axial centerline.

17. A rotor blade pair according to claim 16, wherein said first and second airfoils, spiral around an axis extending between said forward and aft edges of each said airfoil.

18. A rotor blade pair according to claim 17, wherein said first and second walls of said root spiral around an axis extending between said forward and aft edges of said root, an amount substantially equal to that of said airfoils, thereby maintaining said alignment between said airfoils and said walls of said root.

* * * * *